United States Patent [19]

Provencher

[11] 4,433,218

[45] Feb. 21, 1984

[54] ELECTRICAL INSTRUMENT WITH REMOVABLE CALIBRATING KNOB

[75] Inventor: Amede R. Provencher, Marlboro, Mass.

[73] Assignee: Kidde, Inc., Clifton, N.J.

[21] Appl. No.: 293,449

[22] Filed: Aug. 17, 1981

[51] Int. Cl.[3] ..... H01H 19/00; G05G 1/10

[52] U.S. Cl. ..... 200/11 R; 74/553

[58] Field of Search ..... 200/11 R, 11 A, 11 D, 200/11 DA, 11 E, 11 EA, 11 G, 11 H, 11 J, 11 K, 14, 17 R, 336, 318, 321, 325; 74/553

[56] References Cited

U.S. PATENT DOCUMENTS

| | | | |
|---|---|---|---|
| 1,537,227 | 5/1925 | DeWitt | 74/553 X |
| 1,629,891 | 5/1927 | Shaw | 74/553 |
| 2,206,882 | 7/1940 | Davis | 200/11 H |
| 2,264,045 | 11/1941 | Maier | 200/11 H |
| 2,536,445 | 1/1951 | Hoffman | 74/553 X |
| 2,951,358 | 9/1960 | Miller | 74/553 X |
| 3,571,534 | 3/1971 | Ashman | 200/14 X |

*Primary Examiner*—J. R. Scott

*Attorney, Agent, or Firm*—John E. Toupal; Harold G. Jarcho

[57] ABSTRACT

An electrical instrument including a housing with a faceplate, a component for providing a variable electrical characteristic and a control shaft having one end coupled to the component and rotatable to vary the electrical characteristics thereof and an opposite end extending through the faceplate. Attached to the opposite end of the shaft is a coupling that is shaped and arranged so as to prevent relative rotational movement therebetween while allowing relative axial movement therebetween during removal of the coupling from the shaft. A control knob is attached to the coupling in a manner that allows both relative axial and rotational movement therebetween which movement can be restrained by activation of a locking means. An indication of the relative angular position of the knob is provided by a scale located adjacent thereto on the faceplate.

10 Claims, 3 Drawing Figures

ELECTRICAL INSTRUMENT WITH REMOVABLE CALIBRATING KNOB

BACKGROUND OF THE INVENTION

This invention relates generally to an electrical instrument and, more particularly, to a control mechanism for adjusting a variable electrical characteristic of an electrical instrument.

Many electrical instruments such as electrical temperature controllers must be calibrated to insure accurate performance. Typically, such calibration entails adjusting the control shaft of a component that provides a variable electrical characteristic such as resistance, capacitance or inductance. Normally, the control shaft adjustment is made with respect to an appropriate indicator scale and while monitoring a known standard. Most control instruments employ a control knob that functions both as a means for manually adjusting a control shaft and as an indicator dial for an associated scale. Calibration is generally achieved by freely rotating the knob on the control shaft until appropriate registration between the knob and scale is attained and then locking the knob in that position on the shaft with a conventional set screw. A significant drawback of this technique stems from the periodic requirement for removing the control knob to permit a thorough cleaning of the instrument's control panel. Each such removal disturbs the previously established calibrated registration between the control knob and indicator scale thereby necessitating a recalibration of the instrument.

The object of this invention, therefore, is to provide an electrical instrument having a control assembly with a control knob that can be rotationally aligned during a calibration process and subsequently removed without disturbing that calibration.

SUMMARY OF THE INVENTION

The invention is an electrical instrument including a housing with a faceplate, a component for providing a variable electrical characteristic and a control shaft having one end coupled to the component and rotatable to vary the electrical characteristics thereof and an opposite end extending through the faceplate. Attached to the opposite end of the shaft is a coupling that is shaped and arranged so as to prevent relative rotational movement therebetween while allowing relative axial movement therebetween during removal of the coupling from the shaft. A control knob is attached to the coupling in a manner that allows both relative axial and rotational movement therebetween which movement can be restrained by activation of a locking means. An indication of the relative angular position of the knob is provided by a scale located adjacent thereto on the faceplate. During calibration of the instrument, the control knob is rotated on the coupling to establish an appropriate angular position with respect to the scale after which the locking means is activated to restrain such movement. Thereafter, both the knob and coupling can be removed from the shaft as a unit and subsequently replaced without disturbing calibration.

According to specific features of the invention, the shaft possesses a non-circular cross-section and the coupling is a bushing having an inner surface mated thereto so as to prevent relative rotational movement therebetween. The knob has a circular bore that receives an outer circularly cylindrical surface of the bushing so as to facilitate rotational movement therebetween and the locking means is a set screw that threadedly engages the knob and can be screwed into a position also engaging the bushing thereby preventing relative movement therebetween. This arrangement provides the above-described calibration features with an efficient, low cost structural assembly.

According to another feature of the invention, an inner surface portion of the bushing defines a notch that receives the set screw and encompasses an arc of between 40°-60°. The set screw receiving notch prevents dislodgment of the knob from the coupling and limits the range of rotational misalignment therebetween in the event that the set screw inadvertently becomes slightly disengaged from the coupling.

In a preferred embodiment of the invention, the electrical instrument is a temperature controller and the electrical component is a potentiometer. The above-described features of the invention are particularly well suited for use with electrical temperature controllers.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
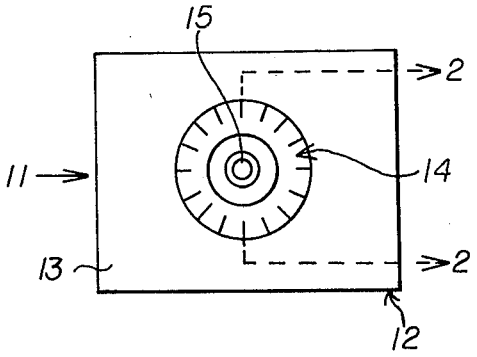
FIG. 1 is a schematic front view of an electrical instrument according to the invention.
Figure 2:
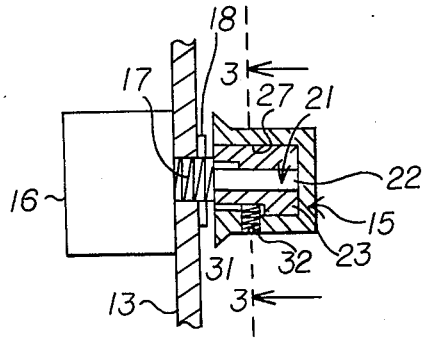
FIG. 2 is a partial schematic cross-sectional view taken along lines 2—2 of FIG. 1.

Illustrated in FIG. 1 is an electrical instrument 11 which preferably consists of an electrical temperature controller. The instrument 11 includes a housing 12 having a faceplate 13. Mounted on the faceplate 13 is an annular scale 14 associated with a control knob 15 described in greater detail below.

Disposed within the housing 12 is a potentiometer 16 having a threaded collar 17 extending through an opening in the faceplate 13 and secured thereto by a nut 18. One end (not shown) of a control shaft 21 is operatively coupled to the potentiometer 16 while an opposite end 22 thereof extends through the collar 17 and the faceplate 13 into a position outside the housing 12. Received by the control shaft 21 is a coupling bushing 23 that in turn receives the control knob 15.

Figure 3:
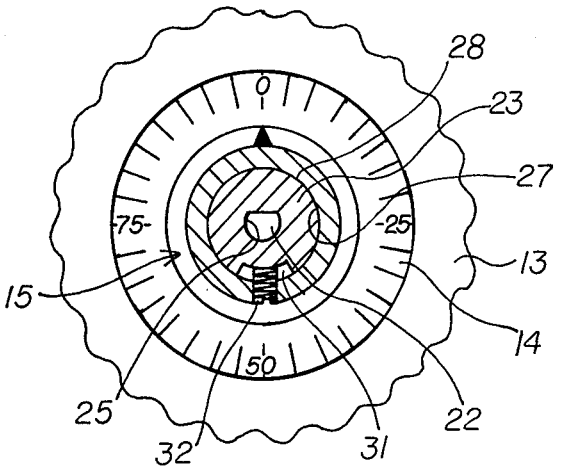
FIG. 3 is a schematic cross-sectional view taken along lines 3—3 of FIG. 2.

As shown in FIG. 3, the opposite end 22 of the shaft 21 possesses a non-circular, D-shaped cross section that is accommodated by a mating inner surface 25 of the bushing 23. The mating shapes of the control shaft end 22 and the inner surface 25 prevent relative rotational movement between the control shaft 21 and the bushing 23 while permitting relative axial movement therebetween. Accommodating a circular bore 27 in the control knob 15 is a circularly cylindrical outer surface 28 on the bushing 23. The circular shapes of the bore 27 and the outer surface 28 permit both relative rotational and axial movement between the control knob 15 and the bushing 23. Defined by an inner portion of the outer bushing surface 28 adjacent to the faceplate 18 is an angular notch 31 having an arcuate length of 50°. The notch 31 receives a set screw 32 that threadedly engages the control knob 15 and can be screwed into active engagement with the bushing 23 so as to restrain relative movement therebetween.

During calibration of the instrument 11, the set screw 32 is moved out of engagement with the bushing 23 so as to allow free rotational movement of the control knob 15 thereon. While suitable calibration equipment is being monitored the knob 15 is then rotated into an appropriate angular position with respect to the scale 14 located on the faceplate 13. Once a calibrated relative angular position between the control knob 15 and the angular scale 14 has been obtained, the set screw 32 is screwed into engagement with the bushing 23 so as to prevent subsequent relative movement between the knob 15 and the bushing 23. The controller instrument 11 is then used in a conventional manner wherein the performance of the controller 11 is altered by rotational adjustment of the control knob 15 to change the electrical resistance characteristics of the potentiometer 16. During such alignment, the control knob 15, the coupling 23 and the control shaft 21 experience identical and simultaneous angular movement because of the rotational coupling provided by the tightened set screw 32 and the non-circular cross sections of the mated control shaft end 22 and the interior surface 25 of the bushing 23.

Assume, however, that removal of the control knob 15 is desired for any reason such as a thorough cleaning of the faceplate 13. In that event, a withdrawal force is applied to the control knob 15 producing axial removal from the control shaft 21 of both the knob 15 and the engaged bushing 23. A subsequent replacement of the control knob 15 does not require recalibration in that the original relative angular positional relationship between the control knob 15 and the bushing 23 has been maintained by the engaged set screw 32 and the original relative angular positional relationship between the bushing 23 and the control shaft 21 is reproduced because of the rotational engagement limitations provided by the D-shaped shaft end 22 and internal bushing surface 25.

The notch 31 prevents axial removal of the knob 15 from the bushing 23 in the event that the set screw 32 inadvertently becomes disengaged from the bushing 23 while remaining in the notch 31. Removal of the knob 15 in that case is prevented by engagement between the set screw 32 and the front wall portion of the notch 31. Preferably, the notch 31 has an arcuate length of between 40°–60°. Such a range allows sufficient relative angular positioning between the control knob 15 and the bushing 23 during calibration of most instruments while limiting the degree of instrument error that will occur should the set screw 32 become disengaged from the bushing 23 while remaining within the notch 31. The permissible error is limited in that case to that degree of relative rotational movement that can occur between the control knob 15 and the bushing 23 before the set screw 32 engages either side wall of the notch 31.

Obviously, many modifications and variations of the present invention are possible in light of the above teachings. It is to be understood, therefore, that the invention can be practical otherwise than as specifically described.

What is claimed is:

1. An electrical instrument comprising:

a housing comprising a face plate;

a component for providing a variable electrical characteristic, said component being retained by said housing;

a shaft having one end coupled to said component and rotatable to vary said electrical characteristics, said shaft extending through said face plate and having an opposite end adjacent thereto;

a coupling means attached to said opposite end of said shaft, said coupling means and said shaft being shaped and arranged to permit only one given relative angular position therebetween and to prevent relative rotational movement therebetween while allowing relative axial movement therebetween during removal of said coupling means from said shaft;

a knob attached to said coupling means, said knob and said coupling means being shaped and arranged to allow both relative axial and rotational movement therebetween;

a locking means activatable to prevent said relative movement between said knob and said coupling means so as to permit removal of said knob and couling from said shaft as a unit and to insure the repositioning thereof in said given relative angular position upon replacement of said unit on said shaft; and a scale located on said face plate adjacent to said knob so as to indicate the relative angular position thereof.

2. An instrument according to claim 1 wherein said opposite end of said shaft possesses a non-circular cross-section, said coupling means comprises a bushing received by said opposite end of said shaft and with an inner surface mated thereto so as to prevent said relative rotational movement therebetween.

3. An instrument according to claim 2 wherein said bushing has a circularly cylindrical outer surface, and said knob has a circular bore for receiving said outer surface and allowing relative rotational movement therebetween.

4. An instrument according to claim 3 wherein said locking means comprises a set screw threadedly engaging said knob and movable into a position engaging said bushing so as to prevent relative movement between said knob and said bushing.

5. An instrument according to claim 4 wherein said outer surface of said bushing comprises an inner surface portion located adjacent to said housing and said inner surface portion defines a notch for receiving said set screw.

6. An instrument according to claim 5 wherein said notch extends along the circumference of said outer surface and an arc of between 40°–60° thereof.

7. An instrument according to claim 1 wherein said instrument is a temperature controller and said component is a potentiometer.

8. An instrument according to claim 7 wherein said opposite end of said shaft possesses a non-circular cross-section, said coupling means comprises a bushing received by said opposite end of said shaft and with an inner surface mated thereto so as to prevent said relative rotational movement therebetween.

9. An instrument according to claim 8 wherein said bushing has a circularly cylindrical outer surface, and said knob has a circular bore for receiving said outer surface and allowing relative rotational movement therebetween.

10. An instrument according to claim 9 wherein said locking means comprises a set screw threadedly engaging said knob and movable into a position engaging said bushing so as to prevent relative movement between said knob and said bushing.

* * * * *